US006430983B1

(12) United States Patent
Nozaki et al.

(10) Patent No.: US 6,430,983 B1
(45) Date of Patent: Aug. 13, 2002

(54) METHOD FOR MANUFACTURING CORRUGATED FIN

(75) Inventors: Kimio Nozaki; Masamitsu Takahashi, both of Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 09/721,661

(22) Filed: Nov. 27, 2000

(30) Foreign Application Priority Data

Nov. 26, 1999 (JP) ..... 11-335346

(51) Int. Cl.[7] ..... B21D 53/04
(52) U.S. Cl. ..... 72/186
(58) Field of Search ..... 72/186, 187, 196

(56) References Cited

U.S. PATENT DOCUMENTS 3,433,044 A * 3/1969 Rhodes et al. ..... 72/186

FOREIGN PATENT DOCUMENTS

| | | | |
|---|---|---|---|
| JP | 55-110892 | 8/1980 | ..... F28F/1/30 |
| JP | 64-66022 | 3/1989 | ..... B21D/13/04 |
| JP | 5-154592 | 6/1993 | ..... B21D/53/08 |
| JP | 7-80558 | 3/1995 | ..... B21D/13/04 |
| JP | 8-229615 | 9/1996 | ..... B21D/13/04 |
| JP | 9-271852 | 10/1997 | ..... B21D/13/04 |

OTHER PUBLICATIONS

Abstract 55110892 Aug. 26, 1980.
Abstract 1066022 03/132/89.
Patent Abstract of Japan 05–154592 Jun. 22, 1993.
Patent Abstract of Japan 07–080558 Mar. 28, 1995.
Patent Abstract of Japan 08–229615 Sep. 10, 1996.
Patent Abstract of Japan 09–271852 Oct. 21, 1997.

* cited by examiner

*Primary Examiner*—Lowell A. Larson
(74) *Attorney, Agent, or Firm*—Sughrue Mion, PLLC

(57) ABSTRACT

A plurality of louvers are formed symmetrically on the two sides of the width-direction central portion of the inclined portion of a corrugated fin, and include, one-side louvers, which are formed integrally in one and the other ends of the central portion, are formed so as to project from one and the other ends of the central portion toward the advancing direction of the corrugated fin and louvers, which are formed on one and the other sides of the central portion, which are formed on one and the other sides of the central portion, are formed inclined on the same sides as the one-side louvers that are formed on one and the other ends of the central portion.

6 Claims, 10 Drawing Sheets

METHOD FOR MANUFACTURING CORRUGATED FIN

BACKGROUND OF THE INVENTION

1. Field of the Invention

The present invention relates to a method for manufacturing a corrugated fin that is disposed and used in a heat exchanger such as a radiator and a heater core.

2. Description of the Related Art

Conventionally, in a heat exchanger such as a radiator and a heater core, a corrugated fin is interposed between tubes to thereby enhance the heat radiating performance of the heat exchanger.

Recently, as a corrugated fin of this type, as shown in FIG. 9, there has been developed a corrugated fin 1 which has a rectangular-shaped corrugated shape.

In the corrugated fin 1, since the bent portions 1*a* thereof are formed to be flat, the brazing strength of the corrugated fin 1 to the tube can be enhanced.

Conventionally, to manufacture the corrugated fin 1, as shown in FIG. 10, a long plate member 3 is continuously supplied between a pair of corrugated cutters 2*a* and 2*b* to thereby form a corrugated fin 4.

FIG. 13 shows an enlarged view of the pair of corrugated cutters 2. The pair of corrugated cutters 2 are an upper corrugated cutter 2*a* and a lower corrugated cutter 2*b*, each formed in a cylindrical shape. A plurality of protrusions and recesses are formed on the surface of each of the upper and lower corrugated cutters 2*a* and 2*b*, and the plurality of protrusions and recesses of the upper and lower corrugated cutters 2*a* and 2*b* are alternatively engaged with each other as the upper and lower corrugated cutters 2*a* and 2*b* rotate.

FIG. 14 is a sectional view taken along a line A—A in FIG. 13, and shows a pair of teeth in the engaging portion of the pair of corrugated cutters 2*a* and 2*b*. FIG. 15 is an enlarged view of FIG. 14. Along with the shapes of the teeth, the pair of corrugated cutters 2*a* and 2*b* partly cut inclined portions 4*b* to define cut portions, and bend the cut portions toward the advancing direction of the long plate member to form a plurality of louvers 7 in the inclined portions 4*b* of the corrugated fin 4. FIG. 12 shows the louvers 7 that are cut and bent by the cutters 2*a* and 2*b*. The louvers 7 include one-side louvers 7*a* and 7*b* formed at both ends of a central portion 4*c* and projected to the opposing direction to the advancing direction, one-side louvers 7*e* and 7*f* formed at ends of both side portions 4*e* in the inclined portions 4*b* and projected to the advancing direction, and a plurality of louvers 7*c* and 7*d* formed between the one-side louvers 7*a* and 7*b* and the one-side louvers 7*e* and 7*f*, respectively.

Then, the thus formed corrugated fin 4 is moved by a pair of feed-out rollers 5. And, the corrugated fin 4 is passed through and between pairs of flick-out plates 6 and is passed through a pitch adjuster, which is not shown, disposed adjacent to the pairs of flick-out plates 6 in the downstream side. The pairs of flick-out plates 6 certainly remove the corrugated fin 4 from the feed-out rollers 5 and adjust the height of each fin of the corrugated fin 4 and the pitch adjuster adjusts the fin pitch of the corrugated fin 4.

That is, in the corrugated fin 4 formed by the pair of corrugated cutters 2*a* and 2*b*, the flat-shaped bent portion 4*a* and the inclined portion 4*b* are alternatively formed so that the corrugated fin 4 has a trapezoidal shape. Then, the corrugated fin 4 is passed through the pairs of flick-out plates 6 and the pitch adjuster to thereby transform the trapezoidal shape of the corrugated fin 4 into a rectangular shape.

However, in the conventional manufacturing method, there is found a problem that the corrugated fin 1 is caught between the pairs of flick-out plates 6.

SUMMARY OF THE INVENTION

The present invention is made to solve the above-mentioned problem. Accordingly, it is an object of the invention to provide a method for manufacturing a corrugated fin, which, when compared with the above-mentioned conventional corrugated fin manufacturing method, can greatly reduce a fear that the corrugated fin can be caught between pairs of flick-out plates.

In attaining the above object, according to the invention, there is provided a method for manufacturing a corrugated fin, in which a long plate member is continuously supplied into between a pair of corrugated cutters to thereby form a corrugated fin having a bent portion formed as a flat-shaped bent portion and including a plurality of louvers formed in the width direction of an inclined portion of the corrugated fin and, after then, the thus formed corrugated fin is passed through between pairs of flick-out plates disposed at positions respectively corresponding to the two width-direction end portions of the flat-shaped bent portion, thereby not only reducing the fin pitch of the corrugated fin but also transforming the shape of the corrugated fin to a shape in which the flat-shaped bent portion extends in parallel to the advancing direction of the corrugated fin. The plurality of louvers are formed symmetrically on the two sides of the width-direction central portion of the inclined portion, one-side louvers, which are formed integrally in one and the other ends of the central portion, are formed so as to project from one and the other ends of the central portion of the inclined portion toward the advancing direction of the corrugated fin, and louvers, which are formed respectively on one and the other sides of the central portion, are formed inclined on the same sides as the one-side louvers that are formed in one and the other ends of the central portion of the inclined portion.

In a method for manufacturing a corrugated fin according to the invention, as described above, the plurality of louvers are formed symmetrically on the two sides of the width-direction central portion 15*c* of the inclined portion, one side louvers, which are formed integrally in one and the other ends of the central portion of the inclined portion, are formed so as to project from one and the other ends of the above-mentioned central portion toward the advancing direction of the corrugated fin, and louvers, which are formed on one and the other sides of the above central portion, are formed inclined on the same sides as the one-side louvers that are formed in one and the other ends of the central portion. Thanks to this, in case where the corrugated fin is passed through between the pairs of flick-out plates disposed at positions respectively corresponding to the two width-direction end portions of the flat-shaped bent portion of the corrugated fin to thereby reduce the fin pitch of the corrugated fin, the two width-direction end portions of the flat-shaped bent portion of the corrugated fin are inclined forwardly, thereby being able to transform the shaped of the corrugated fin into a rectangular shape.

DETAILED DESCRIPTION OF THE PRESENT INVENTION

The present inventors have made every effort to solve the problem found in the conventional manufacturing method and finally have found the following facts.

Figure 11:
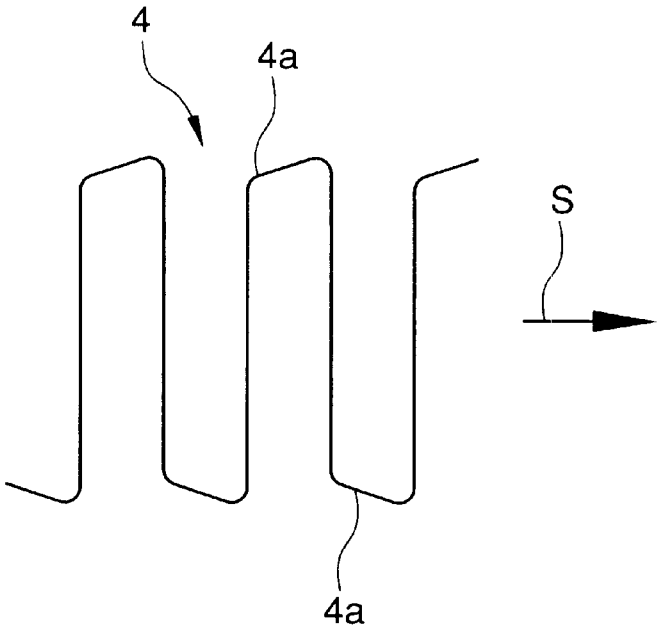
FIG. 11 is an explanatory view of a part of a corrugated fin, showing a state in which the two width-direction end portions of the flat-shaped bent portions of the corrugated fin are inclined backwardly.

That is, in the trapezoidal-shaped corrugated fin 4 that is formed by the pair of corrugated cutters 2, the flat-shaped bent portions 4*a* are formed so as to be parallel to each other in the advancing direction; and, on the other hand, when the corrugated fin 4 is passed through between the pairs of flick-out plates 6 to thereby compress the corrugated fin 4 down to a given fin pitch, the two width-direction end portions of the flat-shaped bent portions 4*a*, as shown in FIG. 11, are inclined backwardly to thereby show such a shape that goes against the advancing direction of the corrugated fin 4.

And, the inventors have also found the fact that such backward inclination is caused by a plurality of louvers which are formed in the inclined portions 4*b* of the corrugated fin 4.

Figure 12:
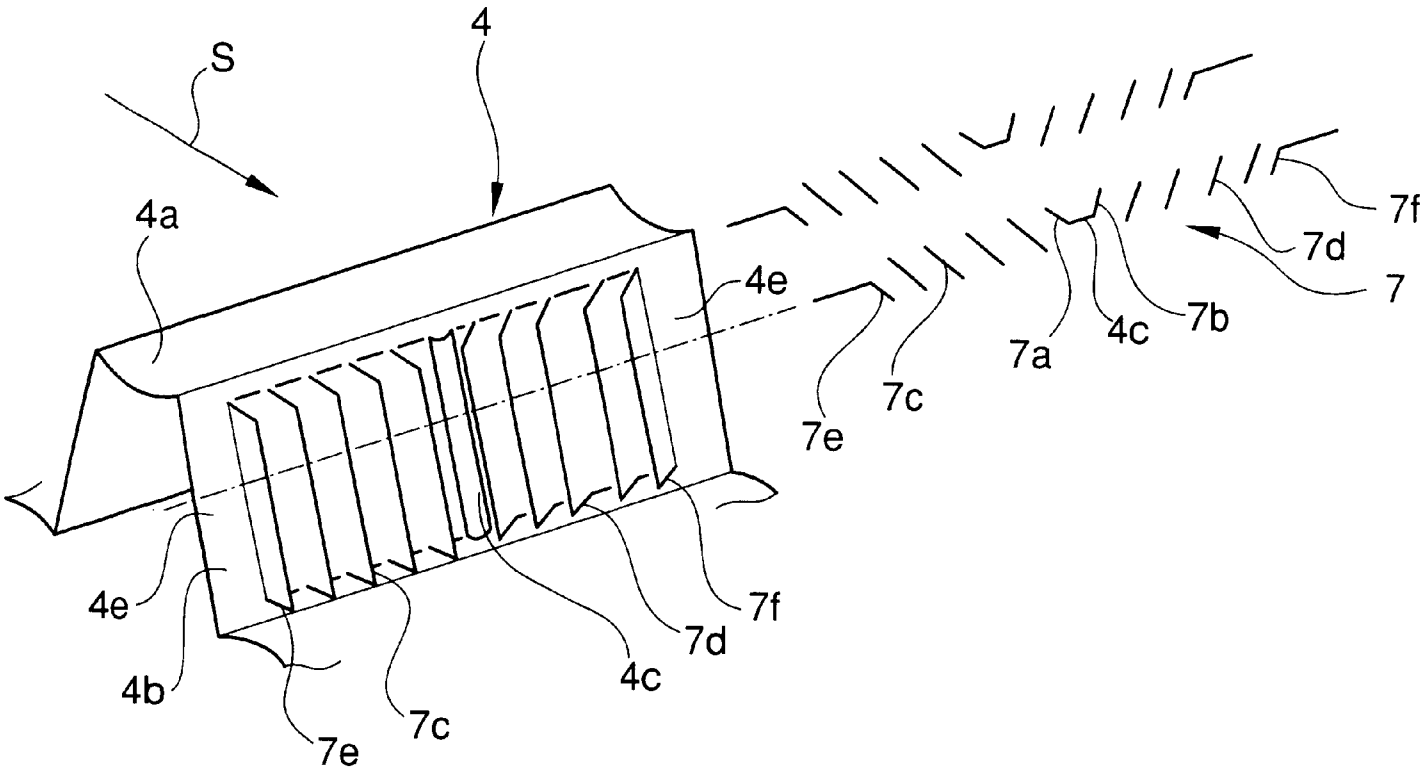
FIG. 12 is an explanatory view of a part of the corrugated fin shown in FIG. 11 and formed using a pair of corrugated cutters.
Figure 13:
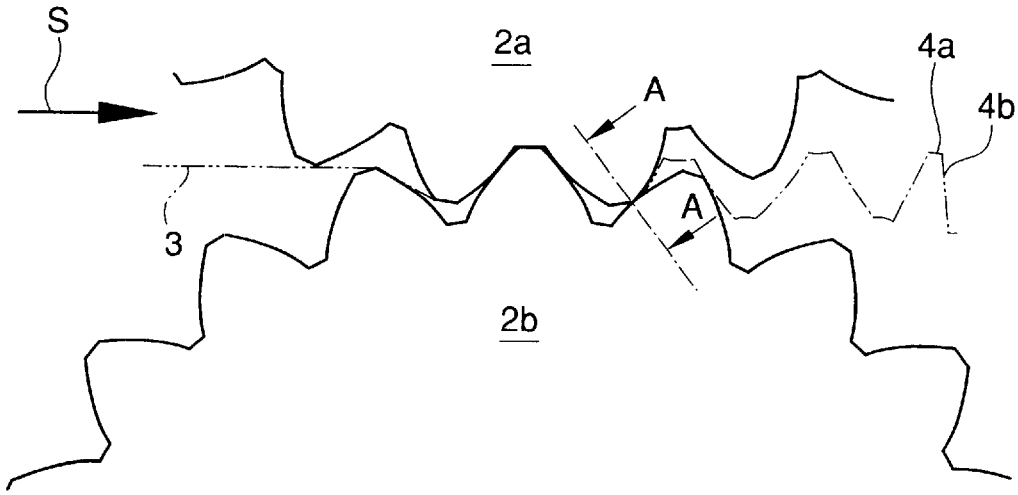
FIG. 13 is a view showing a pair of corrugated cutters.
Figure 14:
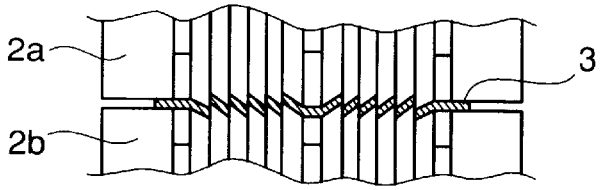
FIG. 14 is a sectional view taken along a line A—A in FIG. 13.
Figure 15:
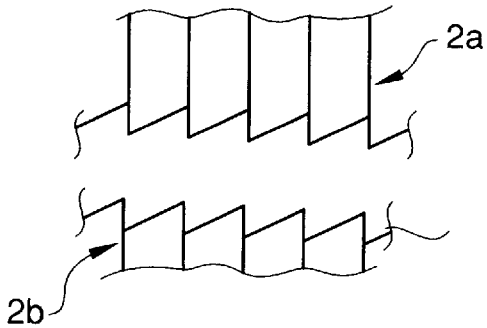
FIG. 15 is an enlarged view of FIG. 14.

That is, in the corrugated fin 4, as shown in FIG. 12, a plurality of louvers 7 are formed symmetrically on the two sides of the width-direction central portion 4*c* of the inclined portion 4*b*. The plurality of louvers 7 include one-side louvers 7*a* and 7*b* formed at both ends of a central portion 4*c* that are projected to the opposing direction to the advancing direction, one-side louvers 7*e* and 7*f* formed at ends of both side portions 4*e* each in the inclined portions 4*b* and projected to the advancing direction, and a plurality of louvers 7*c* and 7*d* formed between the one-side louvers 7*a* and 7*b* and the one-side louvers 7*e* and 7*f*, respectively.

And, the one-side louvers 7*a* and 7*b* are projected respectively from one and the other ends of the central portion 4*c* toward the opposite side to the advancing direction S of the corrugated fin 4. The louvers 7*c* and 7*d* are respectively inclined on the same side as the one-side louvers 7*a* and 7*b*.

However, the one-side louvers 7*e* and 7*f* are respectively projected to the opposing direction to the cutting and raising direction of the one-side louvers 7*a* and 7*b*.

And, in case where the louvers 7 are formed in such a manner that they have the above-mentioned shape, when the corrugated fin 4 is compressed down to a given fin pitch due to the effect of the cutting and raising direction of the louvers 7, the two width-direction end portions of the flat-shaped bent portions 4*a*, as shown in FIG. 11, are inclined backwardly.

The inventors also have found out the fact as explained below using FIGS. 16A and 16B.

Figure 16A:
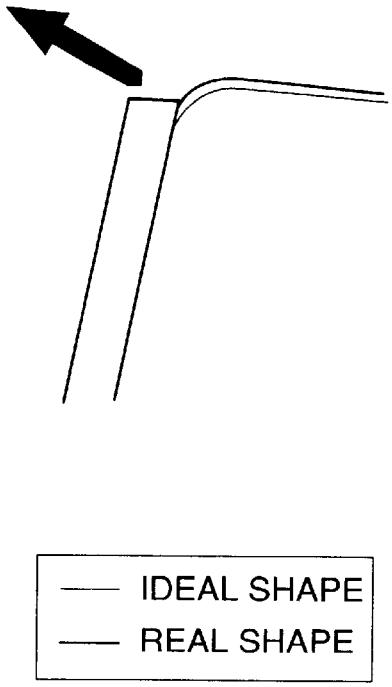
FIGS. 16A and 16B are schematic views for explaining phenomenon causing the problem in the conventional art.
Figure 16B:
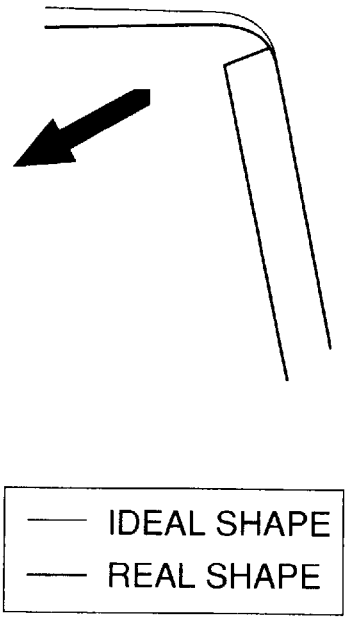

FIGS. 16A and 16B show schematic views for explaining a phenomenon causing the problem in the conventional art. In general, when the long plate member 3 is bent in a rectangular shape to form the corrugated fin 4, the shape of the rectangular shape tends to change depending on the bending direction of the one-side louvers 7*e* and 7*f*.

FIG. 16A shows deformation of the corrugated fin 4 when the one-side louvers 7*e* and 7*f* are bent outward of the protruded shape of the corrugated fin 4, in which a thick line shows a real shape of the corrugated fin 4 deformed, and a normal line shows an ideal shape without any effect of the one-side louvers 7*e* and 7*f*. In the case, outwardly bending the one-side louvers 7*e* and 7*f* forces the plate to move laterally and upwardly as shown by an arrow in FIG. 16A, because the cut portions forming the louvers 7 extend in a bent portion between the flat-shaped bent portion 4*a* and the inclined portion 4*b*.

On the other hand, FIG. 16B shows another deformation of the corrugated fin 4 when the one-side louvers 7*e* and 7*f* are bent inward of the protruded shape of the corrugated fin 4, in which a thick line shows a real shape and a normal line shows an ideal shape of the corrugated fin 4 deformed. In the case, inwardly bending the one-side louvers 7*e* and 7*f* forces the plate to move laterally and downwardly as shown by an arrow in FIG. 16B, because the cutting portions forming the louvers 7 extend in the bent portion between the flat-shaped bent portion 4*a* and the inclined portion 4*b*.

On the other hand, FIG. 16B shows another deformation of the corrugated fin 4 when the one-side rovers 7*e* and 7*f* are bent inward of the protruded shape of the corrugated fin 4, in which a thick line shows a real shape and a normal line shows an ideal shape of the corrugated fin 4 deformed. In the case, inwardly bending the one-side rovers 7*e* and 7*f* forces the plate to move laterally and downwardly as shown by an arrow in FIG. 16B, because the cutting portions forming the rovers 7 extend in the bent portion between the flat-shaped bent portion 4*a* and the inclined portion 4*b*.

In view of the above-mentioned facts found by the inventors, the invention has been made as follows.

PREFERRED EMBODIMENT

Now, description will be given below in detail of an embodiment of a method for manufacturing a corrugated fin according to the invention with reference to the accompanying drawings.

Figure 1:
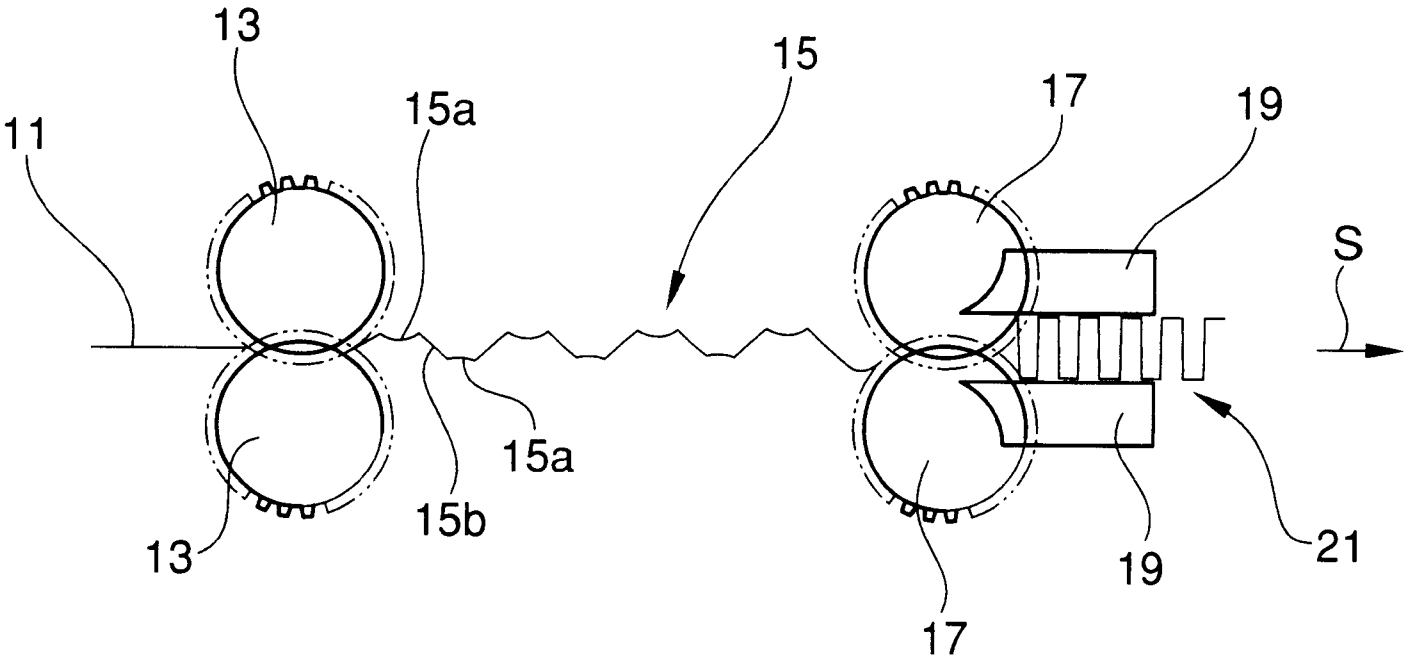
FIG. 1 is an explanatory view of an embodiment of a method for manufacturing a corrugated fin according to the invention.

FIG. 1 shows an embodiment of a method for manufacturing a corrugated fin according to the invention.

In the present corrugated fin manufacturing method, firstly, a long plate member 11 formed of aluminum is continuously supplied through between a pair of corrugated cutters 13 to thereby form a corrugated fin 15.

Figure 6:
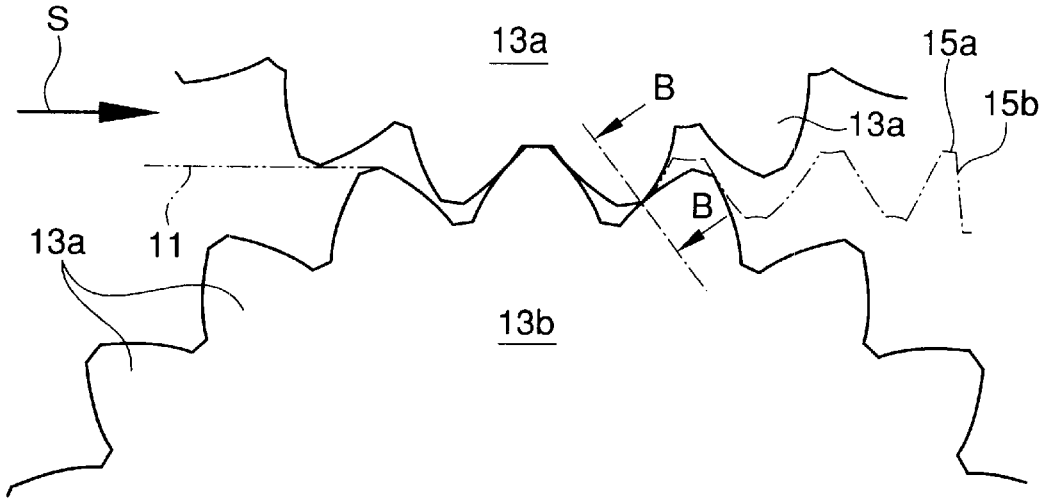
FIG. 6 is a view showing a pair of corrugated cutters.

FIG. 6 shows an enlarged view of the pair of corrugated cutters 13. The pair of corrugated cutters 13 are an upper corrugated cutter 13*a* and a lower corrugated cutter 13*b*, each formed in a cylindrical shape. A plurality of protrusions and recesses are formed on the surface of each of the upper and lower corrugated cutters 13*a* and 13*b*, and the plurality of protrusions and recesses of the upper and lower corrugated cutters 13*a* and 13*b* are alternatively engaged with each other as the upper and lower corrugated cutters 13*a* and 13*b* rotate.

Figure 7:
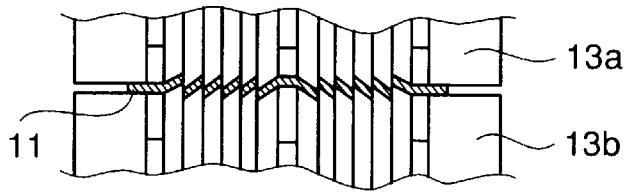
FIG. 7 is a sectional view taken along a line B—B in FIG. 6.
Figure 8:
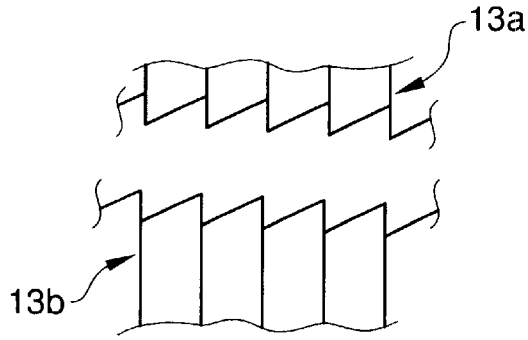
FIG. 8 is an enlarged view of FIG. 7.
Figure 9:
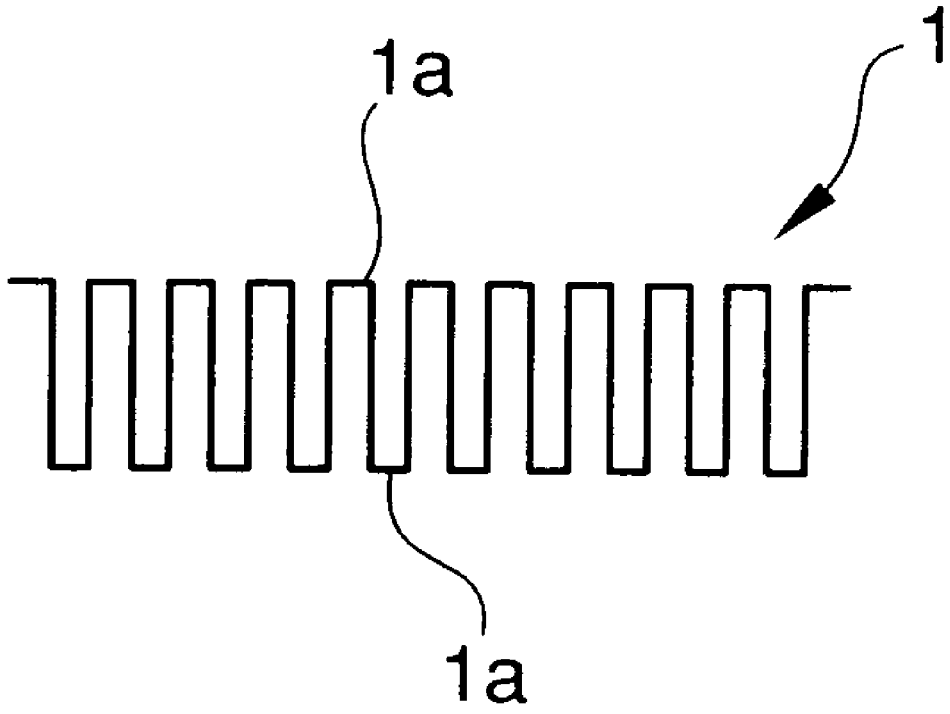
FIG. 9 is an explanatory view of a corrugated fin having a rectangular shape.
Figure 10:
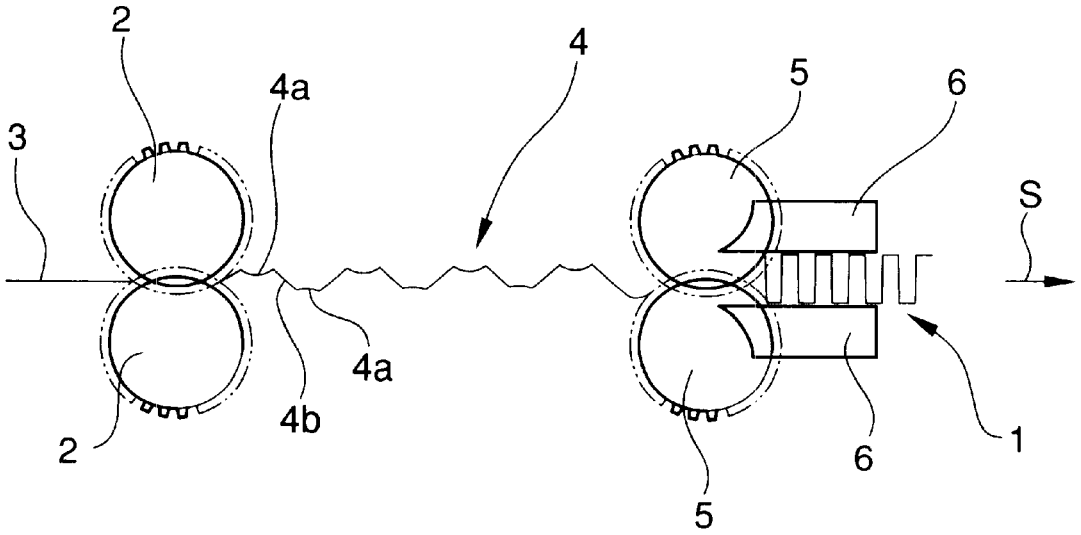
FIG. 10 is an explanatory view of a conventional corrugated fin manufacturing method.

FIG. 7 is a sectional view taken along a line B—B in FIG. 6, and shows a pair of teeth in the engaging portion of the pair of corrugated cutters 13*a* and 13*b*. FIG. 8 is an enlarged view of FIG. 7. Along with the shape of the teeth, the pair of cutters 13*a* and 13*b* partly cut inclined portions 13*b* to define cut portions, and bend the cut portions toward the advancing direction of the long plate member 11 to form a plurality of louvers 23 in the inclined portions 15*b* of the corrugated fin 15.

Then, the thus formed corrugated fin 15 is then guided by a pair of feed-out rollers 17. Then, the fin 15 is passed through between pairs of flick-out plates 19 and is passed through a pitch adjuster, which is not shown, disposed adjacent to the pairs of flick-out plates 19 in the downstream side. The pairs of flick-out plates 19 certainly remove the corrugated fin 15 from the feed-out rollers 17 and adjust the height of each fin of the corrugated fin 15 and the pitch adjuster adjusts the fin pitch of the corrugated fin 15. Then, while the corrugated fin 15 is passing through between the pairs of flick-out plates 19, the corrugated fin 15 is transformed to a rectangular shape, which can manufacture a given corrugated fin 21.

Figure 2:
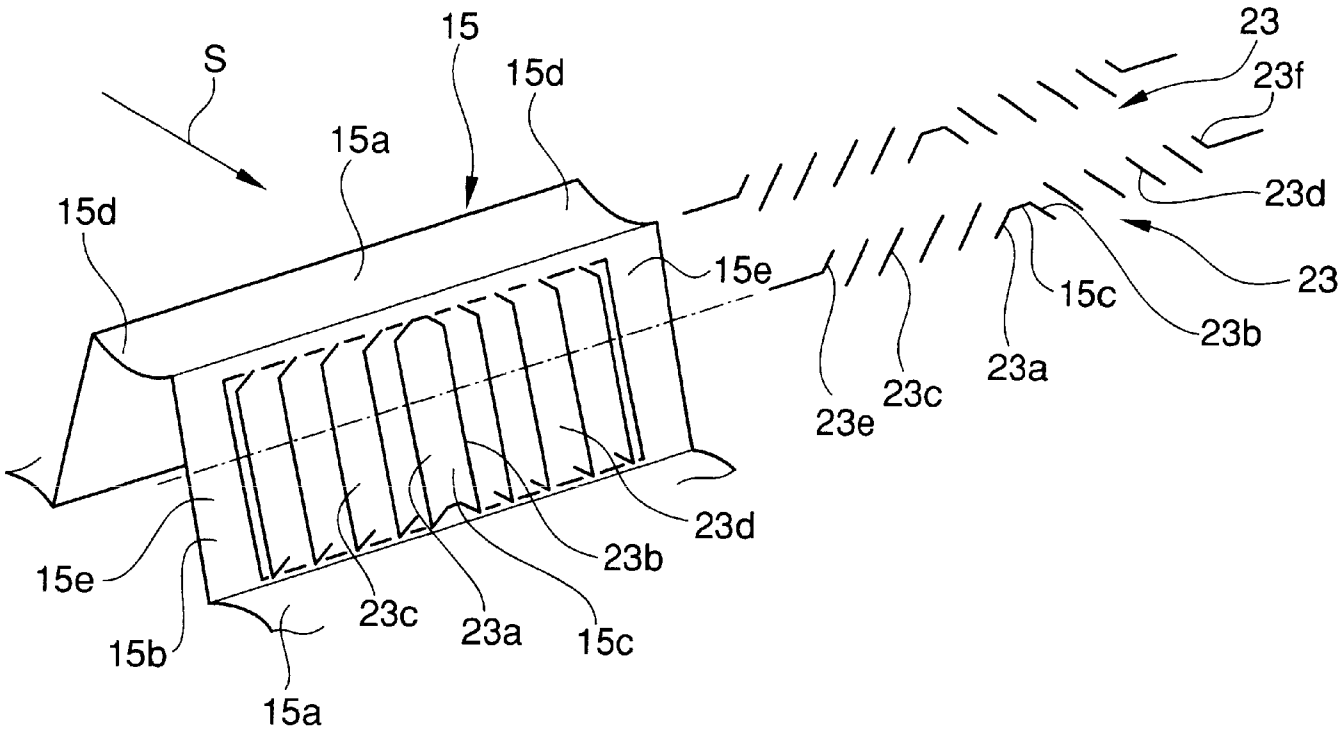
FIG. 2 is an explanatory views of a corrugated fin formed by a pair of corrugated cutters shown in FIG. 1.

Now, FIG. 2 shows the corrugated fin 15 that is formed by the pair of corrugated cutters 13. The corrugated fin 15 is structured such that the flat-shaped bent portion 15*a* and the inclined portions 15*b* are alternatively formed so that the corrugated fin 15 has a trapezoidal shape.

By the way, in this state, each of the flat-shaped bent portions 15*a* is formed so as to have an arc shape which projects inwardly.

And, the plurality of louvers 23 are formed symmetrically on the two sides of the width-direction central portion 15*c* of the inclined portion 15*b* of the corrugated fin 15.

As shown in FIG. 2, the louvers 23 include one-side louvers 23*a* and 23*b* integrally formed at both ends of a center portion 15*c* and projected to the advancing direction, one-side louvers 23*e* and 23*f* formed at ends of both side portions 15*e* in the inclined portions 15*b* and projected to the opposing direction of the advancing direction, and a plurality of louvers 23*c* and 23*d* formed between the one-side louvers 23*a* and 23*b* and the one-side louvers 23*e* and 23*f*, respectively.

Figure 3:
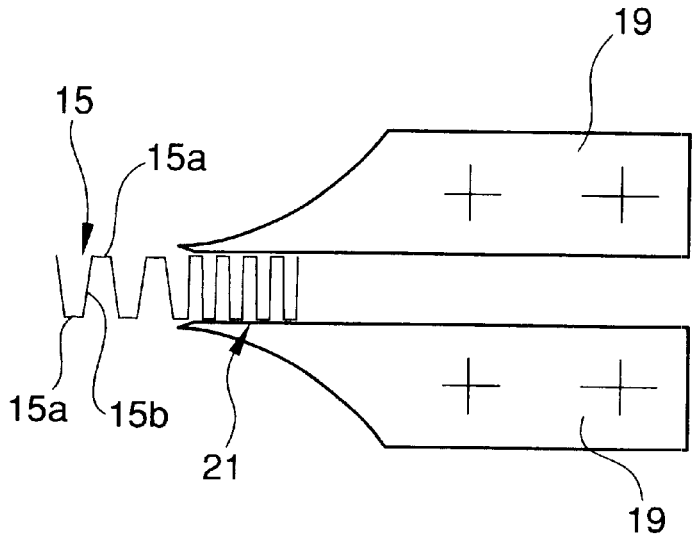
FIG. 3 is an explanatory view of a portion of the embodiment shown in FIG. 1, showing how the corrugated fin is transformed by pairs of flick-out plates.
Figure 4:
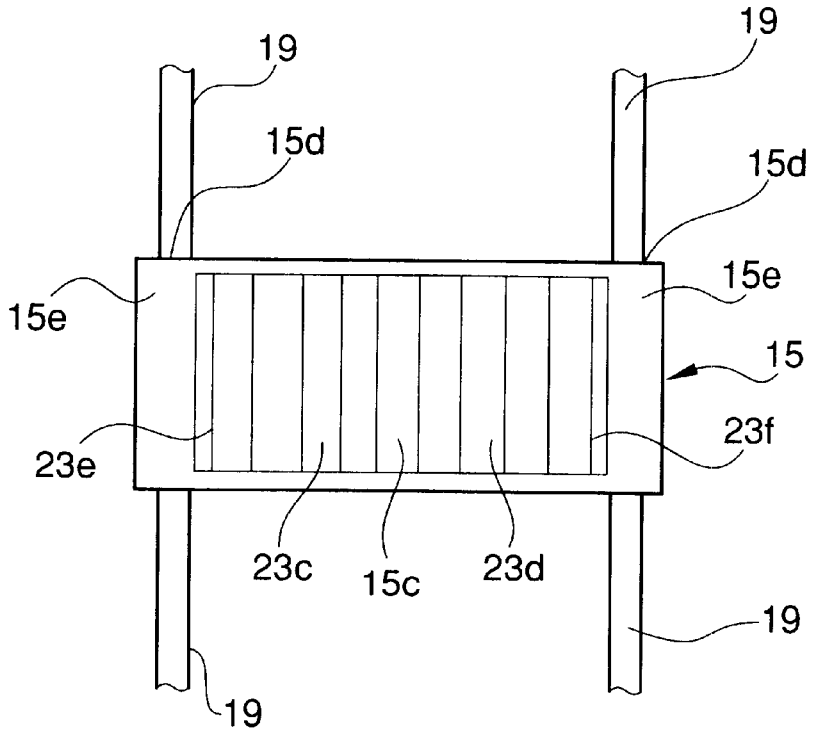
FIG. 4 is a front view of the portion shown in FIG. 3.

Now, FIGS. 3 and 4 respectively show the details of the pairs of flick-out plates 19 that are disposed adjacent to the pair of feed-out rollers 17, in which, while the corrugated fin 15 is passing through between the pairs of flick-out plates 19, the fin pitch of the corrugated fin 15 is compressed to thereby transform the corrugated fin 15 to a rectangular-shaped corrugated fin 21.

That is, in the case of the corrugated fin 15 formed by the pair of corrugated cutters 13, the flat-shaped bent portion 15*a* and the inclined portion 15*b* are alternatively formed so that the corrugated fin 15 has a trapezoidal shape; and, on the other hand, as shown in FIG. 4, in case where the two width-direction end portions 15*d* of the corrugated fin 15 are passed through between the pairs of flick-out plates 19, the fin pitch of the corrugated fin 15 is reduced to thereby transform the trapezoidal shape of the corrugated fin 15 to a rectangular shape.

Figure 5:
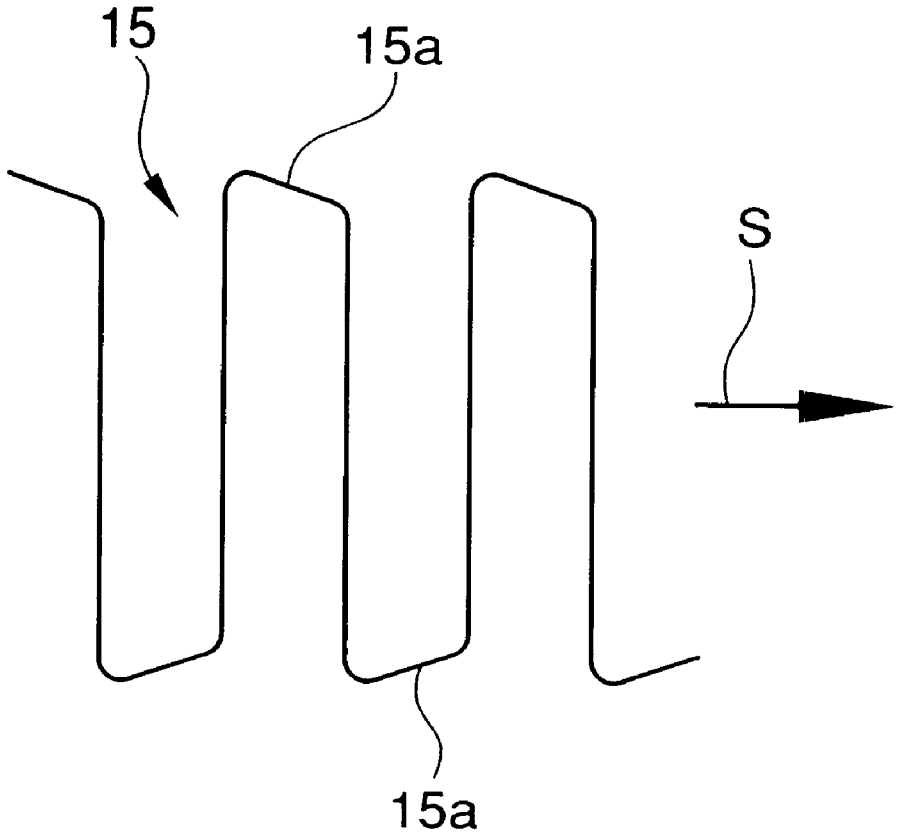
FIG. 5 is an explanatory view of a part of a corrugated fin, showing a state in which the two width-direction end portions of the flat-shaped bent portions of the corrugated fin are inclined forwardly.

And, in the present embodiment, since the louvers 23 each having a shape as shown in FIG. 2 are formed using the pair of corrugated cutters 13, in case where the fin pitch of the corrugated fin 15 is reduced, the two width-direction end portions 15*d* of the flat-shaped bent portions 15*a* of the corrugated fin 15, as shown in FIG. 5, are inclined toward the forward direction (advancing direction S) of the corrugated fin 15 to thereby allow the corrugated fin 15 to provide a shape which follows in the advancing direction of the corrugated fin 15.

Therefore, while preventing the corrugated fin 15 from being caught between the pairs of flick-out plates 19, the corrugated fin 15 can be transformed positively in such a manner that the flat-shaped bent portions 15*a* extend in parallel to the advancing direction S of the corrugated fin 15.

That is, in the above-mentioned corrugated fin manufacturing method, in case where the corrugated fin 15 is passed through between the pairs of flick-out plates disposed at positions respectively corresponding to the two width-direction end portions 15*d* to thereby reduce the fin pitch, the two width-direction end portions 15*d* of the flat-shaped bent portions 15*a* of the corrugated fin 15 are inclined forwardly to thereby provide a shape which follows in the advancing direction of the corrugated fin 15. Due to this, when compared with the conventional corrugated fin manufacturing method, there can be greatly reduced a fear that the corrugated fin 15 can be caught between the pairs of flick-out plates 19.

Also, in the above-mentioned embodiment, description has been given of a case in which the corrugated fin 15 is fed using the pair of feed-out rollers 17. However, the invention is not limited to this embodiment but, alternatively, the corrugated fin 15 may also be fed directly into between the pairs of flick-out plates 19.

In addition to the two pairs of flick-out plates, additional pairs of flick-out plates may be set between the pairs of flick-out plates 19.

As has been described heretofore, in a method for manufacturing a corrugated fin according to the invention, in case where a corrugated fin is passed through between pairs of flick-out plates disposed at positions respectively corresponding to the two width-direction end portions of the corrugated fin to thereby reduce the fin pitch of the corrugated fin, the two width-direction end portions of the flat-shaped bent portions of the corrugated fin are inclined forwardly to thereby provide a shape which follows in the advancing direction. Due to this, when compared with the conventional corrugated fin manufacturing method, there can be greatly reduced a fear that the corrugated fin can be caught between the pairs of flick-out plates.

Also, according to the present invention, there can be greatly reduced a fear that the corrugated fin can be caught in the pitch adjuster.

What is claimed is:

1. A method for manufacturing a corrugated fin, the method comprising:

continuously supplying a long plate member between a pair of corrugated cutters to form a corrugated fin having a flat-shaped bent portion and including a plurality of louvers formed in a width direction of an inclined portion of the corrugated fin; and passing the corrugated fin between pairs of flick-out plates disposed at positions respectively corresponding to two width-direction end portions of the flat-shaped bent portion, thereby reducing a fin pitch of the corrugated fin and transforming a shape of the corrugated fin so that the flat-shaped bent portion extends in parallel to an advancing direction of the corrugated fin, wherein the plurality of louvers are formed symmetrically on two sides of a width-direction central portion of the inclined portion;

wherein the plurality of louvers includes one-side louvers, which are formed integrally in one and the other ends of the central portion, are formed so as to project from one and the other ends of the central portion of the inclined portion toward the advancing direction of the corrugated fin; and wherein the plurality of louvers includes a plurality of louvers, which are formed respectively on one and the other sides of the central portion, are formed inclined on the same sides as the one-side louvers that are formed in one and the other ends of the central portion of the inclined portion.

2. A method for manufacturing a corrugated fin, the method comprising:

supplying a long plate member between a pair of corrugated cutters to form a corrugated fin having a bent portion formed in a flat and an inclined portion;

forming a plurality of louvers symmetrically on two sides of a width-direction central portion of the inclined portion; and forming one-side louvers formed integrally at two ends of both side portions of the inclined portion to project toward an opposing direction of an advancing direction of the corrugated fin.

3. The method as claimed in claim 2, further comprising a step of passing the corrugated fin between a pair of flick-out plates disposed at positions respectively corresponding to two width-direction ends of the bent portion, to reduce a fin pitch of the corrugated fin and transform the corrugated fin to a shape in which the bent portion extends in parallel to the advancing direction of the corrugated fin.

4. The method as claimed in claim 3, further comprising:

forming two inclined portions each integrally connected to the bent portion and each having a plurality of louvers formed in the width direction; and forming the one-side louvers formed integrally at the two ends of both side portions of the two inclined portions to project toward the opposing direction of the advancing direction of the corrugated fin.

5. A corrugated fin forming apparatus comprising:

a pair of corrugated cutters for forming a corrugated fin having a flat shaped bent portion and an inclined portion having a plurality of louvers formed in the width direction, the pair of corrugated cutters for forming a plurality of louvers symmetrically on two sides of a width-direction central portion of the inclined portion, the pair of corrugated cutters for forming one-side louvers formed integrally at two ends of both side portions of the inclined portion to project toward an opposing direction of an advancing direction of the corrugated fin; and a pair of flick-out plates disposed at positions respectively corresponding to two width-direction ends of the bent portion, the pair of flick-out plates for reducing a fin pitch of the corrugated fin and transforming the corrugated fin to a shape in which the bent portion extends in parallel to the advancing direction of the corrugated fin.

6. The corrugated fin forming apparatus as claimed in claim 5, wherein the pair of corrugated cutters forms two inclined portions each integrally connected to the bent portion and each having a plurality of louvers formed in the width direction; and the pair of corrugated cutters forms one-side louvers formed integrally at two ends of both side portions of the inclined portion to project toward the opposing direction of the advancing direction of the corrugated fin.

* * * * *